US006660347B2

(12) United States Patent
Steiger

(10) Patent No.: US 6,660,347 B2
(45) Date of Patent: Dec. 9, 2003

(54) RECORDING SHEETS FOR INK JET PRINTING

(75) Inventor: Rolf Steiger, Praroman (CH)

(73) Assignee: Ilford Imaging Switzerland GmbH (CH)

( * ) Notice: Subject to any disclaimer, the term of this patent is extended or adjusted under 35 U.S.C. 154(b) by 0 days.

(21) Appl. No.: 10/074,406

(22) Filed: Feb. 12, 2002

(65) Prior Publication Data

US 2002/0164459 A1 Nov. 7, 2002

(30) Foreign Application Priority Data

Feb. 12, 2001 (EP) ..... 01810139

(51) Int. Cl.[7] ..... B41M 5/00
(52) U.S. Cl. ..... 428/32.16
(58) Field of Search ..... 428/195, 328, 428/331, 480, 500, 524, 537.5, 696, 32.16, 32.25, 32.27, 32.34

(56) References Cited

U.S. PATENT DOCUMENTS

| | | | | | |
|---|---|---|---|---|---|
| 3,906,141 | A | * | 9/1975 | Anderson et al. | 428/411 |
| 4,425,405 | A | * | 1/1984 | Murakami et al. | 428/342 |
| 5,073,448 | A | | 12/1991 | Vierira et al. | |
| 6,132,879 | A | * | 10/2000 | Tamura et al. | 428/411.1 |
| 6,136,083 | A | * | 10/2000 | Schmidt et al. | 106/403 |
| 6,156,419 | A | | 12/2000 | Brugger et al. | |
| 6,203,899 | B1 | * | 3/2001 | Hirose et al. | 428/341 |
| 6,207,258 | B1 | * | 3/2001 | Varnell | 428/195 |
| 6,228,475 | B1 | * | 5/2001 | Chu et al. | 428/304.4 |
| 6,277,498 | B1 | * | 8/2001 | Endo et al. | 428/500 |
| 6,426,167 | B2 | * | 7/2002 | Yau et al. | 430/14 |
| 6,514,598 | B1 | * | 2/2003 | Totani et al. | 428/195 |

FOREIGN PATENT DOCUMENTS

| | | | |
|---|---|---|---|
| EP | 0373573 | A1 | 6/1990 |
| EP | 0534634 | A1 | 3/1993 |
| EP | 0685345 | A1 | 12/1995 |
| EP | 0875394 | A1 | 11/1998 |
| EP | 1034940 | A1 | 9/2000 |
| EP | 1 034 940 | A1 * | 9/2000 |
| EP | 1197345 | A1 | 4/2002 |
| GB | 2088777 | A | 6/1982 |
| JP | 1-301359 | | 12/1989 |
| WO | WO 00/37574 | | 6/2000 |

OTHER PUBLICATIONS

"Ozone Problem with Epson Photo Paper," *Hard Copy Supplies Journal* 6(7), 35–36 (2000).

* cited by examiner

*Primary Examiner*—Bruce H. Hess
*Assistant Examiner*—B. Shewareged
(74) *Attorney, Agent, or Firm*—Dara L. Onofrio, Esq.; Onofrio Law

(57) ABSTRACT

A recording sheet for ink jet printing which consists of a support having coated thereon at least one ink-receiving layer consisting of binders, a porous inorganic oxide and copper salts, wherein the copper salts are salts of monovalent copper. In a preferred embodiment of the invention the recording sheet contains copper(I) chloride and optionally substituted 1,3-cyclohexandione.

9 Claims, No Drawings

RECORDING SHEETS FOR INK JET PRINTING

FIELD OF THE INVENTION

The present invention relates to new stabilizers for recording sheets used in ink jet printing, containing nanoporous inorganic oxides or oxides/hydroxides.

BACKGROUND OF THE INVENTION

Ink jet printing processes are mainly of two types: continuous stream and drop-on-demand.

In continuous stream ink jet printing systems, a continuous ink stream is emitted under pressure through a nozzle. The stream breaks up into droplets at a certain distance from the nozzle. If a specific location on the recording sheet has to be printed the individual droplets are directed to the recording sheet, otherwise they are directed to a gutter. This is done for example by charging unnecessary droplets in accordance with digital data signals and passing them through an electric static field which adjusts the trajectory of these droplets in order to direct them to the gutter. The inverse procedure may also be used wherein uncharged droplets are directed to the gutter.

In the non-continuous process, or the so-called "drop-on-demand" systems, a droplet is generated in accordance with digital data signals only if it is to be placed onto the recording sheet.

The printing speed of modern ink jet printers is always increasing for economical reasons. Recording sheets that are suitable for these printers therefore need to absorb the inks very quickly. Especially suitable are recording sheets containing nanoporous inorganic oxides.

Such recording sheets available today do not meet all of the required demands. In particular, the light stability and the storage stability of images printed on these recording sheets have to be improved. These images are not particularly stable when they are in contact with ambient air, which normally contains sulfur dioxide and, especially in summer, photochemically generated impurities such as ozone or nitrogen oxides. The images are strongly altered or even destroyed in a short time when they are in contact with ambient air. These phenomena are described for example in Hardcopy Supplies Journal, 6 (7), 35 (2000).

In patent application EP 0,373,573 derivatives of polyhydroxybenzenes are proposed as stabilizers for recording sheets for ink jet printing.

Patent application EP 0,534,634 describes the deposition of salt solutions containing at least a bivalent metal cation onto recording sheets for ink jet printing in order to improve the water fastness of the printed images. The copper salts $CuCl_2$, $CuBr_2$, $Cu(NO_3)_2$, $Cu(ClO_3)_2$ and $Cu(C_2H_3O_2)_2$ are mentioned explicitly.

Patent application JP 1-301,359 describes the addition of organic sulfonates or organic sulfates in combination with copper or nickel salts of monocarboxylic acids to recording sheets for ink jet printing in order to improve the light stability of the printed images. The copper salts copper formate and copper acetate are mentioned explicitly.

In patent application GB 2,088,777 derivatives of phenols and bisphenols are proposed in order to improve the stability of recording sheets containing nanoporous inorganic oxides or oxides/hydroxides.

In patent application EP 0,685,345 the addition of dithiocarbamates, thiocyanates, thiurams or sterically hindered amines to recording sheets containing nanoporous inorganic oxides or oxides/hydroxides is proposed in order to improve their stability.

Patent application WO 00/37,574 describes the addition of bivalent salts of carboxylic acids with at least 4 carbon atoms of copper, nickel, cobalt or manganese to inks as well as to recording sheets for ink jet printing in order to improve the light stability of the printed images. In the examples of table 4 copper gluconate is added to coating compositions containing pseudo-boehmite particles of size smaller than 500 nm and a styrene-acrylic copolymer. The coating compositions are coated subsequently onto transparent polyethylene terephthalate films. No results relating to the stability of images printed onto such recording sheets are given.

Patent application EP 1,034,940 describes a recording sheet that contains, in an ink-receiving layer, binders, a porous inorganic oxide and water-soluble polyvalent metal ions, among others also copper(II) ions.

All of these proposed additives increase the water fastness and the light stability of recording sheets for ink jet printing containing nanoporous inorganic oxides or oxides/hydroxides. However, they do not or only marginally increase the stability of the recording sheets when these are in contact with contaminated ambient air.

European patent application 00810941.5 describes the addition of unsubstituted or substituted 1,3-cyclohexanedione to recording sheets for ink jet printing containing nanoporous inorganic oxides or oxides/hydroxides in order to increase the stability of printed images when these are in contact with contaminated ambient air.

The additives proposed therein however do not sufficiently increase the stability of recording sheets for ink jet printing containing nanoporous inorganic oxides or oxides/hydroxides when these are in contact with contaminated ambient air.

Stabilizing additives for such recording sheets containing nanoporous inorganic oxides or oxides/hydroxides need to be sufficiently soluble and compatible with the other ingredients of the mainly aqueous coating compositions. They need to be colorless or are allowed to be only slightly colored. Furthermore, these additives need to be stable when the recording sheets or the images printed thereon are stored over long periods of time and they are not allowed to yellow or become inactive. Additionally they need to be non-toxic and inoffensive.

There is therefore a need to improve, in addition to the ink absorption capacity, the image quality, the water fastness, the light stability etc., in particular the storage stability of recording sheets containing nanoporous inorganic oxides or oxides/hydroxides when they are in contact with ambient air containing impurities such as ozone, nitrogen oxides or sulfur dioxide.

SUMMARY OF THE INVENTION

An objective of the invention is to provide recording sheets containing nanoporous inorganic oxides or oxides/hydroxides with improved storage stability when in contact with ambient air, where images recorded thereon can be observed by both reflected and transmitted light, and consist of a support having coated thereon at least one ink-receiving layer.

We have found that the addition of salts of salts of monovalent copper not only increases the light stability of recording sheets for ink jet printing containing nanoporous inorganic oxides or oxides/hydroxides, but surprisingly also the storage stability in contact with contaminated ambient air. Images printed onto such recording sheets according to the invention show considerably less change of colors and/or dye losses when in contact with ambient air containing impurities such as ozone, nitrogen oxides or sulfur dioxide in comparison to images printed onto recording sheets not containing such additives.

The recording sheets for ink jet printing according to the invention contain in the coated layers, besides the nanoporous inorganic oxide or oxide/hydroxide and the salts of monovalent copper one or more binders. The salts of monovalent copper may be incorporated into the ink-receiving layer containing the nanoporous inorganic oxide or oxide/hydroxide, or into an other layer of the recording sheet. CuCl is especially effective.

Advantageously unsubstituted or substituted 1,3-cyclohexanedione is incorporated into the recording sheets in addition to the monovalent copper salts.

DETAILED DESCRIPTION OF THE INVENTION

The invention describes a recording sheet for ink jet printing consisting of a support having coated thereon one or more layers comprising, besides at least one nanoporous inorganic oxide or oxide/hydroxide and binders in an ink-receiving layer, salts of monovalent copper. The nanoporous inorganic oxide or oxide/hydroxide and the salts of monovalent copper may be contained in the same or in different layers.

Copper(I) chloride, copper(I) bromide and copper(I) sulfite monohydrate are particularly effective.

Such a recording sheet contains one or more of the compounds mentioned above. Their quantity is from 1 $mg/m^2$ to 1'000 $mg/m^2$, preferably from 10 $mg/m^2$ to 600 $mg/m^2$ of these compounds.

It is especially preferred if, in addition to the copper salts, compounds of formulas Ia (diketo form) and Ib (enol form), as described in European patent application 00810941.5, are incorporated into the recording sheets for ink jet printing containing a nanoporous inorganic oxide or oxide/hydroxide,

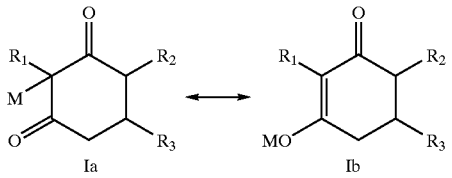

wherein in formula Ib (enol form)

M represents a hydrogen cation, a metal cation such as Li, Na or K, a triethanolamine cation or an ammonium cation optionally substituted by one or more alkyl or substituted alkyl groups each having from 1 to 18 C atoms;

$R_1$ represents hydrogen, alkyl with 1 to 12 C atoms or substituted alkyl with 2 to 6 C atoms, wherein the substituents are selected from the group consisting of CN, COOH, OH and $COOR_4$, where $R_4$ represents alkyl with 1 to 12 C atoms; and $R_2$, $R_3$ independently represent hydrogen, alkyl with 1 to 6 C atoms or substituted alkyl with 2 to 6 C atoms, wherein the substituents are selected from the group consisting of CN, COOH, OH and $COOR_5$, where $R_5$ represents alkyl with 1 to 12 C atoms.

Preferably from 50 $mg/m^2$ to 600 $mg/m^2$ of these compounds are added to the recording sheet.

Colloidal silicium dioxide, colloidal aluminium oxide or colloidal aluminium oxide/hydroxide may be used as nanoporous inorganic oxide or oxide/hydroxide. Colloidal aluminium oxide, colloidal aluminium oxide/hydroxide or positively charged silicium dioxide are preferred. Especially preferred as colloidal aluminium oxide is $\gamma$-$Al_2O_3$ and as colloidal AlOOH an AlOOH reacted with salts of the rare earth metal series as described in patent application EP 0,875,394. This nanoporous aluminium oxide/hydroxide contains one or more elements of the rare earth metal series of the periodic system of the elements with atomic numbers 57 to 71, preferably in a quantity from 0.4 to 2.5 mole percent relative to $Al_2O_3$. Especially preferred as nanoporous aluminium oxide/hydroxide is pseudo-boehmite, an agglomerate of aluminium oxide/hydroxide of formula $Al_2O_3.nH_2O$ where n is from 1 to 1.5, or pseudo-boehmite reacted with the salts of the rare earth metal series as also described in patent application EP 0,875,394. This nanoporous pseudo-boehmite contains one or more elements of the rare earth metal series of the periodic system of the elements with atomic numbers 57 to 71, preferably in a quantity from 0.4 to 2.5 mole percent relative to $Al_2O_3$.

It has been found that only the addition of nanoporous substances having a pore volume of $\mu$20 ml/100 g, as determined by the BET isotherm method, to the ink-receiving layers considerably increases the absorption rate and the absorption capacity for aqueous inks. Only such inorganic oxides or oxides/hydroxides should be considered as being "nanoporous".

The recording sheet may contain, in addition to the nanoporous inorganic oxides or oxides/hydroxides, other inorganic oxides or oxides/hydroxides not being considered to be nanoporous according to the preceding definition.

The recording sheet may at the same time contain more than one or more than one kind of nanoporous inorganic oxides or oxides/hydroxides in the same or in different layers. Especially preferred is a layer combination wherein a lower layer contains AlOOH reacted with salts of the rare earth metal series and an upper layer contains positively charged silicium dioxide.

The binders are in most cases water-soluble polymers. Especially preferred are film forming polymers.

The water soluble polymers include for example natural polymers or modified products thereof such as albumin, gelatin, casein, starch, gum arabicum, sodium or potassium alginate, hydroxyethyl cellulose, carboxymethyl cellulose, $\alpha$-, $\beta$-, or $\gamma$-cyclodextrine and the like. In the case where one of the water-soluble polymers is gelatin, all known types of gelatin may be used as for example acid pigskin or limed bone gelatin, acid or base hydrolyzed gelatin, but also derivatised gelatins like for instance phthalaoylated, acetylated or carbamoylated gelatin or gelatin derivatised with the anhydride of trimellitic acid.

A preferred natural binder is gelatin.

Synthetic binders may also be used and include for example polyvinyl alcohol, polyvinyl pyrrolidone, completely or partially saponified products of copolymers of vinyl acetate and other monomers; homopolymers or copolymers of unsaturated carboxylic acids such as (meth) acrylic acid, maleic acid, crotonic acid and the like; homopolymers or copolymers of sulfonated vinyl monomers such as vinylsulfonic acid, styrene sulfonic acid and the like. Furthermore homopolymers or copolymers of vinyl monomers of (meth)acrylamide; homopolymers or copolymers of other monomers with ethylene oxide; polyurethanes; polyacrylamides; water soluble nylon type polymers; polyesters; polyvinyl lactams; acrylamide polymers; substituted polyvinyl alcohol; polyvinyl acetals; polymers of alkyl and sulfoalkyl acrylates and methacrylates; hydrolyzed polyvinyl acetates; polyamides; polyvinyl pyridines; polyacrylic acid; copolymers with maleic anhydride; polyalkylene oxides; methacrylamide copolymers and maleic acid copolymers may be used. All these polymers may also be used as mixtures.

Preferred synthetic binders are polyvinyl alcohol and polyvinyl pyrrolidone or mixtures thereof.

These polymers may be blended with water insoluble natural or synthetic high molecular weight compounds, particularly with acrylate latices or with styrene acrylate latices.

Although not specifically claimed in this invention water insoluble polymers are nevertheless considered to be part of the system.

The polymers mentioned above having groups with the possibility to react with a cross-linking agent may be cross-linked or hardened to form essentially water insoluble layers. Such cross-linking bonds may be either covalent or ionic. Cross-linking or hardening of the layers allows for the modification of the physical properties of the layers, like for instance in water absorption of the layer or in resistance against layer damage.

The cross-linking agents or hardeners are selected depending on the type of the water-soluble polymers to be cross-linked.

Organic cross-linking agents and hardeners include for example aldehydes (such as formaldehyde, glyoxal or glutaraldehyde), N-methylol compounds (such as dimethylol urea or methylol dimethylhydantoin), dioxanes (such as 2,3-dihydroxydioxane), reactive vinyl compounds (such as 1,3,5-trisacrylolyl hexahy-dro-s-triazine or bis-(vinylsulfonyl)methyl ether), reactive halogen compounds (such as 2,4-dichloro-6-hydroxy-s-triazine), epoxides, aziridines, carbamoyl pyridinium compounds or mixtures of two or more of the above mentioned cross-linking agents.

Inorganic cross-linking agents or hardeners include for example chromium alum, aluminium alum or boric acid.

The layers may also contain reactive substances that cross-link the layers under the influence of ultraviolet light, electron beams, X-rays or heat.

The layers may be modified by the addition of fillers. Possible fillers are for instance kaolin, Ca- or Ba-carbonates, silicium dioxide, titanium dioxide, bentonites, zeolites, aluminium silicate, calcium silicate or colloidal silicium dioxide. Likewise, the possibility exists to use organic inert particles such as polymer beads. These beads may consist of polyacrylates, polyacrylamides, polystyrene or different copolymers of acrylates and styrene. The fillers are selected according to the intended use of the printed images. Some of these compounds cannot be used if the printed images are to be used as transparencies. However they are of interest in cases where the printed images are be to used as remission pictures. Very often the introduction of such fillers causes a wanted matte surface.

The recording sheets may further contain, in addition to the copper salts according to the invention, other water-soluble metal salts, as for example salts of the alkaline earths or salts of the rare earth metal series.

The recording sheets according to the invention comprise a support having coated thereon at least one ink-receiving layer, and, optionally, auxiliary layers.

A wide variety of supports are known and commonly used in the art. They indude all those supports used in the manufacture of photographic materials. This includes clear films made from cellulose esters such as cellulose triacetate, cellulose acetate, cellulose propionate or cellulose acetate/butyrate, polyesters such as polyethylene terephthalate or polyethylene naphthalate, polyamides, polycarbonates, polyimides, polyolefins, polyvinyl acetals, polyethers, polyvinyl chloride and polyvinylsulfones. Polyester film supports, and especially polyethylene terephthalate or polyethylene naphthalate are preferred because of their excellent dimensional stability characteristics. The usual supports used in the manufacture of opaque photographic materials may be used including for example baryta paper, polyolefin coated papers, voided polyester as for instance manufactured by DuPont under the trade name of Melinex®. Especially preferred are polyolefin coated paper or voided polyester.

When such support materials, in particular polyester, are used, a subbing layer is advantageously coated first to improve the bonding of the ink-receiving layers to the support. Useful subbing compositions for this purpose are well known in the photographic industry and include for example terpolymers of vinylidene chloride, acrylonitrile and acrylic acid or of vinylidene chloride, methyl acrylate and itaconic acid.

Also used as supports are plain paper, comprising all different types of papers varying widely in their composition and in their properties. Pigmented papers and cast-coated papers may also be used, as well as metal foils, such as foils made from aluminium.

The layers may also be coated onto textile fiber materials consisting for example of polyamides, polyesters, cotton, viscose, or wool.

The additive according to the invention may be added to any layer of the recording sheet.

The ink-receiving layers according to the invention are in general coated from aqueous solutions or dispersions containing all necessary ingredients. In many cases, surfactants are added to those coating solutions in order to improve the coating behavior and the evenness of the layers. Besides being necessary for coating purposes, these compounds may have an influence on the image quality and may therefore be selected with this specific goal in mind. Although not specifically claimed in this invention surfactants nevertheless form an important part of the invention.

It is also possible to deposit the copper salts in a separate step onto the recording sheet containing nanoporous oxides or oxides/hydroxides.

In addition to the above mentioned compounds recording sheets according to the invention may contain additional compounds aimed at further improving their performance, as for example brightening agents to improve the whiteness, such as stilbenes, coumarines, triazines, oxazoles or others compounds known to someone skilled in the art.

Light stability may be improved by adding UV absorbers such as 2-hydroxybenzotriazoles, 2-hydroxybenzophenones, triazine derivatives or derivatives of cinnamic acids. The amount of UV absorber may vary from 200 mg/m$^2$ to 2000 mg/m$^2$, preferably from 400 mg/m$^2$ to 1000 mg/m$^2$. The UV absorber may be added to any of the layers of the recording sheet according to the invention. It is preferred that, however, if it is added, it should be added to the topmost layer.

It is further known that images produced by ink jet printing may be protected from degradation by the addition of radical scavengers, stabilizers, reducing agents and antioxidants. Examples of such compounds are sterically hindered phenols, sterically hindered amines, chromanols, ascorbic acid, phosphinic acid and its derivatives, sulfur containing compounds such as sulfides, mercaptans, thiocyanates, thioamides or thioureas.

The above-mentioned additives may be added as aqueous solutions to the coating solutions. In the case where these compounds are not sufficiently water-soluble, they may be incorporated into the coating solutions by other common techniques known in the art. The compounds may for example be dissolved in a water miscible solvent such as lower alcohols, glycols, ketones, esters, or amides. Alternatively, the compounds may be added to the coating solutions as fine dispersions, as oil emulsions, as cyclodextrine inclusion compounds or incorporated into latex particles.

Typically, the recording sheet according to the invention has a thickness in the range of 0.5 $\mu$m to 100 $\mu$m dry thickness, preferably in the range of 5 $\mu$m to 50 $\mu$m dry thickness.

The coating solutions may be coated onto the support by any number of suitable procedures. Usual coating methods include for example extrusion coating, air knife coating, doctor blade coating, cascade coating and curtain coating. The coating solutions may also be applied using spray techniques. The ink-receiving layers may be built up from several single layers that can be coated one after the other or simultaneously. It is likewise possible to coat a support on both sides with ink-receiving layers. It is also possible to coat an antistatic layer or an anticurl layer on the backside. The selected coating method however is not to be considered limiting for the present invention.

It is also possible to immerse a recording sheet in a solution of the copper salt in order to incorporate the copper salt into the recording sheet. The copper salt solution solutions may also be applied using spray techniques, for example by using an ink jet printer.

Inks for ink jet printing consist in essence of a liquid vehicle and a dye or pigment dissolved or suspended therein. The liquid vehicle for ink jet inks consists in general of water or a mixture of water and a water miscible organic solvent such as ethylene glycol, higher molecular weight glycols, glycerol, dipropylene glycol, polyethylene glycol, amides, polyvinyl pyrrolidone, N-methylpyrrolidone, cyclohexyl pyrrolidone, carboxylic acids and their esters, ethers, alcohols, organic sulfoxides, sulfolane, dimethylformamide, dimethylsulfoxide, cellosolve, polyurethanes, acrylates and the like.

The non-aqueous parts of the ink generally serve as humefactants, cosolvents, viscosity regulating agents, ink penetration additives or drying agents. The organic compounds have in most cases a boiling point, which is higher than that of water. In addition, aqueous inks used for printers of the continuous stream type may contain inorganic or organic salts to increase their conductivity. Examples of such salts are nitrates, chlorides, phosphates and salts of water-soluble organic acids such as acetates, oxalates and citrates. The dyes and pigments suitable for the preparation of inks useable with the recording sheets according to the invention cover practically all classes of known coloring compounds. Dyes or pigments typically used for this purpose are described in patent application EP 0,559,324. The recording sheets according to the invention are meant to be used in conjunction with most of the inks representing the state of the art.

Other additives present in inks are for instance surfactants, optical brighteners, UV absorbers, light stabilizers, biocides, precipitating agents such as multivalent metal compounds and polymeric additives.

The copper salts mentioned above may also be incorporated into the inks. This description of inks is for illustration only and is not to be considered as limiting for the purpose of the invention.

The present invention will be illustrated in more detail by the following examples without limiting the scope of the invention in any way.

EXAMPLES

Comparison Example C-1

Preparation of the Coating Solution 85.5 g of Disperal® (aluminium oxide/hydroxide, available from CONDEA GmbH, Hamburg, Germany) were dispersed at a temperature of 40° C. in 220 g of aqueous lactic acid (0.7%). Afterwards, 76.95 g of a solution of polyvinyl alcohol (10%, hydrolysis degree 98–99%, molecular weight 85'000 to 146'000, available from ALDRICH Chemie, Buchs, Switzerland) were added. Finally, the total weight was adjusted to 449.7 g with deionised water, and the solution was exposed to ultrasound for three minutes.

Coating 149.9 g/m$^2$ of this coating solution were coated at a temperature of 40° C. onto a polyethylene coated paper support. The coated support was then dried for 60 minutes at a temperature of 30° C. 1 m$^2$ of the coated support contains, in addition to the other coating ingredients, 22.2 g of nanoporous inorganic oxide, calculated as $Al_2O_3$, and 2.56 g of polyvinyl alcohol.

Example 1

Preparation of the Coating Solution 0.3 g of CuCl (available from Fluka Chemie AG, Buchs, Switzerland) were added as solid to the coating solution of Comparison Example C-1 at a temperature of 4° C.

Coating 150 g/m$^2$ of this coating solution were coated at a temperature of 40° C. onto a polyethylene coated paper support. The coated support was then dried for 60 minutes at a temperature of 30° C. 1 m$^2$ of the coated support contains, in addition to the other coating ingredients, 22.2 g of nanoporous inorganic oxide, calculated as $Al_2O_3$, 2.56 g of polyvinyl alcohol and 100 mg of CuCl.

Comparison Example C-2

Preparation of Aluminium Oxide/Hydroxide Doped with La (2.2 Mole Percent Relative to $Al_2O_3$)

50 g of aluminium oxide/hydroxide Disperal® were dispersed at a temperature of 20° C. for 15 minutes under vigorous mechanical stirring in 948 g of doubly distilled water. Afterwards, temperature was increased to 90° C. and stirring was continued for 15 minutes at this temperature. 2.04 g of $LaCl_3$ (available from Fluka Chemie AG, Buchs, Switzerland) were added as a solid and stirring was continued for 120 minutes. The solid was filtered off, washed three times with doubly distilled water and dried at 110° C.

Preparation of the Coating Solution

The same quantity of aluminium oxide/hydroxide doped with La was used in place of Disperal® in the coating solution of Comparison Example C-1.

Coating 149.9 g/m$^2$ of this coating solution were coated at a temperature of 40° C. onto a polyethylene coated paper support. The coated support was then dried for 60 minutes at a temperature of 30° C. 1 m$^2$ of the coated support contains, in addition to the other coating ingredients, 22.2 g of nanoporous inorganic oxide, calculated as $Al_2O_3$, and 2.56 g of polyvinyl alcohol.

Example 2

Preparation of the Coating Solution 0.3 g of CuCl were added as solid to the coating solution of Comparison Example C-2 at a temperature of 40° C.

Coating 150 g/m$^2$ of this coating solution were coated at a temperature of 40° C. onto a polyethylene coated paper support. The coated support was then dried for 60 minutes at a temperature of 30° C. 1 m$^2$ of the coated support contains, in addition to the other coating ingredients, 22.2 g of nanoporous inorganic oxide, calculated as $Al_2O_3$, 2.56 g of polyvinyl alcohol and 100 mg of CuCl.

Comparison Example C-3

Preparation of the Coating Solution

The total weight of the coating solution of Comparison Example C-2 was adjusted to 447 g. Afterwards, 3 g of a solution (10%) of $CuSO_4$ (available from Fluka Chemie AG, Buchs, Switzerland) were added at a temperature of 40° C.

Coating 150 g/m$^2$ of this coating solution were coated at a temperature of 40° C. onto a polyethylene coated paper support. The coated support was then dried for 60 minutes at a temperature of 30° C. 1 m$^2$ of the coated support contains, in addition to the other coating ingredients, 22.2 g of nanoporous inorganic oxide, calculated as $Al_2O_3$, 2.56 g of polyvinyl alcohol and 100 mg of $CuSO_4$.

Comparison Examples C-3a–C-3e

Preparation of the Coating Solutions 3 g of the metal salt solutions (10%) listed in Table 1 were added to the coating solution of Example 3 in place of the solution of copper(II) sulfate at a temperature of 4° C.

TABLE 1

| Comparison Example | Compound |
|---|---|
| C-3a | $ZnCl_2$ |
| C-3b | $FeCl_3$ |
| C-3c | $FeSO_4$ |
| C-3d | $Ni(NO_3)_2$ |
| C-3e | $Zr(SO_4)_2$ |

$ZnCl_2$, $FeCl_3$, $FeSO_4$ and $Ni(NO_3)_2$ are available from Fluka Chemie AG, Buchs, Switzerland. $Zr(SO_4)_2$ is available from ALDRICH Chemie, Buchs, Switzerland.

Coatings 150 g/m$^2$ of these coating solutions were coated at a temperature of 4° C. onto a polyethylene coated paper support. The coated support was then dried for 60 minutes at a temperature of 30° C. 1 m$^2$ of the coated support contains, in addition to the other coating ingredients, 22.2 g of nanoporous inorganic oxide, calculated as $Al_2O_3$, 2.56 g of polyvinyl alcohol and 100 mg of the corresponding metal salt.

Example 4

Preparation of the Coating Solution 0.3 g of CuCl (available from Fluka Chemie AG, Buchs, Switzerland) and 600 mg of 1,3-cyclohexanedione (available from Acros Organics, Geel, Belgium) were added, both as solids, to the coating solution of Comparison Example C-2 at a temperature of 40° C.

Coating 150.2 g/m$^2$ of this coating solution were coated at a temperature of 40° C. onto a polyethylene coated paper support. The coated support was then dried for 60 minutes at a temperature of 30° C. 1 m$^2$ of the coated support contains, in addition to the other coating ingredients, 22.2 g of nanoporous inorganic oxide, calculated as $Al_2O_3$, 2.56 g of polyvinyl alcohol, and 100 mg of CuCl and 200 mg of 1,3-cyclohexanedione.

Comparison Example C-5

Preparation of an Aqueous Dispersion of Positively Charged Silicium Dioxide 60 g of Aerosil 200 (available from Degussa AG, Frankfurt/Main, Germany) were dissolved under exposure to ultrasound at a temperature of 25° C. in 216 g of aqueous acetic acid (2.87%). Afterwards, 9.86 g of an aqueous solution of aluminium chlorohydrate (47.7%, prepared from aluminium chlorohydrate of formula $Al_2(OH)_5Cl.2.5\ H_2O$, available as Locron® from Clariant AG, Muttenz, Switzerland) were added and the resulting solution was stirred for 3 hours. Finally, the total weight was adjusted to 300 g.

Preparation of the Coating Solution 60 g of this aqueous dispersion of positively charged silicium dioxide were diluted under stirring at a temperature of 40° C. with 4.6 g of water and mixed with 30.4 g of a solution of polyvinyl alcohol (10%). The total weight was adjusted to 100 g with deionised water and the solution was exposed to ultrasound.

Coating 100 g/m$^2$ of this coating solution were coated at a temperature of 40° C. onto a polyethylene coated paper support. The coated support was then dried for 60 minutes at a temperature of 30° C. 1 m$^2$ of the coated support contains, in addition to the other coating ingredients, 12 g of positively charged silicium dioxide and 2.28 g of polyvinyl alcohol.

Example 5

Preparation of the Coating Solution 50 mg of CuCl were added as solid under stirring to 100 g of the coating solution of Comparison Example C-5 at a temperature of 40° C.

Coating 100.05 g/m$^2$ of this coating solution were coated at a temperature of 40° C. onto a polyethylene coated paper support. The coated support was then dried for 60 minutes at a temperature of 30° C. 1 m$^2$ of the coated support contains, in addition to the other coating ingredients, 12 g of positively charged silicium dioxide, 2.28 g of polyvinyl alcohol and 50 mg of CuCl.

Comparison Example C-6

Preparation of an Aqueous Dispersion of Aluminium Oxide 96.6 g of Alu C (Content 96.6% of $Al_2O_3$, available from DEGUSSA AG, Frankfurt/Main, Germany) were dispersed under stirring and exposure to ultrasound at a temperature of 25° C. in 507.5 g of aqueous acetic acid (3.45%). After 30 minutes the total weight was adjusted to 700 g with deionised water.

Preparation of the Coating Solution 60 g of this aqueous dispersion of $Al_2O_3$ were diluted under stirring with 10.5 g of deionised water and mixed with 23.2 g of a solution of polyvinyl alcohol (7.5%). The total weight was adjusted to 100 g with deionised water and the solution was exposed to ultrasound.

Coating 125 g/m$^2$ of this coating solution were coated at a temperature of 40° C. onto a polyethylene coated paper support. The coated support was then dried for 60 minutes at a temperature of 30° C. 1 m$^2$ of the coated support contains, in addition to the other coating ingredients, 18.13 g of $Al_2O_3$ and 2.28 g of polyvinyl alcohol.

Example 6

Preparation of the Coating Solution 80 mg of CuCl were added as solid under stirring to 100 g of the coating solution of Comparison Example C-6 at a temperature of 40° C.

Coating 125 g/m$^2$ of this coating solution were coated at a temperature of 40° C. onto a polyethylene coated paper support. The coated support was then dried for 60 minutes at a temperature of 30° C. 1 m$^2$ of the coated support contains, in addition to the other coating ingredients, 18.13 g of $Al_2O_3$, 2.28 g of polyvinyl alcohol and 100 mg CuCl.

Example 7

Lower Layer

The Lower Layer is Identical to The Coated Layer of Example 2.

Preparation of the Coating Solution for the Upper Layer 1.154 g of 1,3-cyclohexanedione were added under vigorous stirring to 60 g of the aqueous dispersion of positively charged silicium dioxide of Comparison Example C-5 at a temperature of 40° C. Afterwards, 18.4 g of a solution of polyvinyl alcohol (10%) were added and the total weight was adjusted to 100 g with deionised water.

Upper Layer 24 g/m$^2$ of this coating solution were coated onto the lower layer.

Coating 1 m$^2$ of the coated support contains altogether 25.08 g of nanoporous inorganic oxides, 100 mg of CuCl and 277 mg of 1,3-cyclohexanedione.

The following methods were used to determine the stability of the prepared recording sheets in contact with ambient air and the light stability:

Stability in Contact with Ambient Air

Grey patches with an approximate density of 1.60 of three color black were printed onto the recording sheets according to the invention with an ink jet printer EPSON STYLUS™ COLOR 750 in PQ-glossy-film-modus (720 dpi) using original inks.

The printed samples were exposed unsealed on a table for two weeks under normal daylight conditions (1000 lux to 2000 lux) to ambient air under moderate air circulation. The density loss due to this light exposure is extremely small under these conditions.

The density loss of the cyan dye was measured with an X-Rite® densitometer equipped with a red filter. It is expressed as percent loss of initial density of the cyan dye.

Light Stability

Color patches with an approximate density of 1.60 in the colors dark magenta, dark cyan and blue and color patches with an approximate density of 0.50 in the colors light and light cyan were printed onto the recording sheets according to the invention with an ink jet printer EPSON STYLUS™ COLOR 750 in PQ-glossy-film-modus (720 dpi) using original inks.

The printed samples were irradiated in an ATLAS Ci35A Weather-O-Meter® with a 6500 W Xenon lamp until a total illumination of 40 kJoule/cm$^2$ was reached.

The densities of the color patches were measured with an X-Rite® densitometer equipped with a red filter. The density loss is expressed as percent loss of initial density.

Results

The density losses obtained during exposure to ambient air under these experimental conditions are listed in Table 2 for recording sheets according to the invention containing the nanoporous inorganic aluminium oxide/hydroxide Disperal®.

TABLE 2

| Example | Density loss of the cyan dye in % |
|---|---|
| 1 | 25 |
| C-1 | 41 |

The results in Table 2 immediately show that the recording sheet for ink jet printing according to the invention containing the nanoporous inorganic aluminum oxide/hydroxide Disperal® and the additive copper(I) chloride (Example 1) shows much lower density losses of the cyan dye than a corresponding recording sheet not containing such an additive (Comparison Example C-1).

Even after 5 months of storage of the recording sheet according to the invention containing the additive copper(I) chloride under these conditions the density loss of the cyan dye is much lower than in a corresponding recording sheet not containing this additive.

The density losses obtained during exposure to ambient air under these experimental conditions are listed in Table 3 for recording sheets according to the invention containing La modified nanoporous aluminium oxide/hydroxide.

TABLE 3

| Example | Density loss of the cyan dye in % |
|---|---|
| 2 | 23 |
| 4 | 8 |
| C-2 | 40 |
| C-3 | 30 |
| C-3a | 44 |
| C-3b | 55 |
| C-3c | 54 |
| C-3d | 40 |
| C-3e | 41 |

The results in Table 3 immediately show that the recording sheet for ink jet printing according to the invention containing La modified nanoporous aluminium oxide/hydroxide and the additive copper(I) chloride (Example 2) shows much lower density losses of the cyan dye than a corresponding recording sheet not containing such an additive (Comparison Example C-2). The density loss is particularly low when the recording sheet additionally contains 1,3-cyclohexanedione (Example 4).

The results in Table 3 further show that a recording sheet for ink jet printing containing La modified nanoporous aluminium oxide/hydroxide and the additive copper(II) sulfate (Comparison Example C-3) shows much lower density losses of the cyan dye than a corresponding recording sheet containing other salts mentioned in patent application EP 0,534,634 (Comparison Examples C-3a to C-3e).

The density losses obtained during exposure to ambient air under these experimental conditions are listed in Table 4 for recording sheets according to the invention containing positively charged silicium dioxide.

TABLE 4

| Example | Density loss of the cyan dye in % |
|---|---|
| 5 | 25 |
| C-5 | 40 |

The results in Table 4 immediately show that the recording sheet for ink jet printing according to the invention containing positively charged silicium dioxide and the additive copper(I) chloride (Example 5) shows much lower density losses of the cyan dye than a corresponding recording sheet not containing such an additive (Comparison Example C-5).

The density losses obtained during exposure to ambient air under these experimental conditions are listed in Table 5 for recording sheets according to the invention containing nanoporous $Al_2O_3$.

TABLE 5

| Example | Density loss of the cyan dye in % |
|---|---|
| 6 | 24 |
| C-6 | 45 |

The results in Table 5 immediately show that the recording sheet for ink jet printing according to the invention containing nanoporous $Al_2O_3$ and the additive copper(I) chloride (Example 6) shows much lower density losses of the cyan dye than a corresponding recording sheet not containing such an additive (Comparison Example C-6).

The density loss obtained during exposure to ambient air under these experimental conditions is listed in Table 6 for a double layer recording sheet according to the invention containing La modified nanoporous aluminium oxide/hydroxide and nanoporous positively charged silicium dioxide.

TABLE 6

| Example | Density loss of the cyan dye in % |
|---|---|
| 12 | 1 |

The result in Table 6 immediately shows that the recording sheet for ink jet printing containing La modified nanoporous aluminium oxide/hydroxide and nanoporous positively charged silicium dioxide and the additive copper(I) chloride and additionally 1,3-cyclohexanedione according to the invention (Example 6) shows nearly no density loss of the cyan dye any more.

Even after 8 weeks of storage the density loss of the cyan dye in this recording sheet is only 4%. The corresponding recording sheet containing only the additive copper(I) chloride, but no 1,3-cyclohexanedione, shows a density loss of the cyan dye of 41%. The corresponding recording sheet containing no CuCl, but the same quantity of 1,3-cyclohexanedione, shows a density loss of the cyan dye of 55%. The corresponding recording sheet containing no CuCl and no 1,3-cyclohexanedione shows a density loss of the cyan dye of 60%.

The density losses obtained during exposure to light under these experimental conditions are listed in Table 7 for recording sheets according to the invention containing the nanoporous inorganic aluminium oxide/hydroxide Disperal®

TABLE 7

| | % Density loss | | | | | |
|---|---|---|---|---|---|---|
| Example | Light Magenta | Dark Magenta | Light Cyan | Dark Cyan | Blue through red filter | Blue through green filter |
| 1 | 8 | 5 | 14 | 6 | 4 | 8 |
| C-1 | 29 | 24 | 46 | 32 | 31 | 35 |

The results in Table 7 immediately show that the recording sheet for ink jet printing containing the nanoporous inorganic aluminium oxide/hydroxide Disperal® and the additive copper(I) chloride according to the invention (Example 1) shows much lower density losses in all dye patches than the corresponding recording sheet not containing such an additive (Comparison Example C-1).

The density losses obtained during exposure to light under these experimental conditions are listed in Table 8 for recording sheets according to the invention containing La modified nanoporous aluminium oxide/hydroxide.

TABLE 8

| | % Density loss | | | | | |
|---|---|---|---|---|---|---|
| Example | Light Magenta | Dark Magenta | Light Cyan | Dark Cyan | Blue through red filter | Blue through green filter |
| 2 | 10 | 7 | 13 | 6 | 5 | 8 |
| 4 | 9 | 6 | 20 | 8 | 7 | 9 |
| C-2 | 24 | 22 | 45 | 30 | 30 | 31 |
| C-3 | 17 | 11 | 40 | 33 | 16 | 16 |
| C-3a | 30 | 25 | 48 | 40 | 30 | 33 |
| C-3b | 88 | 90 | 67 | 42 | 38 | 69 |
| C-3c | 88 | 89 | 72 | 48 | 41 | 71 |
| C-3d | 38 | 32 | 42 | 31 | 26 | 31 |
| C-3e | 30 | 25 | 46 | 33 | 33 | 36 |

The results in Table 8 immediately show that recording sheets for ink jet printing according to the invention containing La modified nanoporous aluminium oxide/hydroxide and the additive copper(I) chloride (Examples 2 to 4) show much lower density losses in all dye patches than the corresponding recording sheet not containing such an additive (Comparison Example C-2). The addition of 1,3-cyclohexanedione does not influence light stability (Example 4).

The results in Table 8 further show that the recording sheet for ink jet printing containing La modified nanoporous aluminium oxide/hydroxide and the additive copper(II) sulfate (Example 3) shows lower density losses in all dye patches than the corresponding recording sheets containing other salts mentioned in patent application EP 0,534,634 (Comparison Examples C-3a to C-3e). These other salts even degrade light stability.

The density losses obtained during exposure to light under these experimental conditions are listed in Table 9 for recording sheets according to the invention containing positively charged silicium dioxide.

TABLE 9

| | % Density loss | | | | | |
|---|---|---|---|---|---|---|
| Example | Light Magenta | Dark Magenta | Light Cyan | Dark Cyan | Blue through red filter | Blue through green filter |
| 5 | 14 | 9 | 16 | 5 | 1 | 6 |
| C-5 | 62 | 49 | 28 | 12 | 17 | 19 |

The results in Table 9 immediately show that the recording sheet for ink jet printing according to the invention containing nanoporous positively charged silicium dioxide and the additive copper(I) chloride (Example 5) shows much lower density losses in all dye patches than the corresponding recording sheet not containing such an additive (Comparison Example C-5).

The density losses obtained during exposure to light under these experimental conditions are listed in Table 10 for recording sheets according to the invention containing nanoporous $Al_2O_3$.

TABLE 10

| | % Density loss | | | | | |
|---|---|---|---|---|---|---|
| Example | Light Magenta | Dark Magenta | Light Cyan | Dark Cyan | Blue through red filter | Blue through green filter |
| 6 | 24 | 9 | 29 | 9 | 0 | 10 |
| C-6 | 57 | 24 | 52 | 10 | 10 | 25 |

The results in Table 10 immediately show that the recording sheet for ink jet printing according to the invention containing nanoporous $Al_2O_3$ and the additive copper(I) chloride (Example 6) shows much lower density losses in all dye patches than the corresponding recording sheet not containing such an additive (Comparison Example C-6).

What is claimed is:

1. Recording sheet for ink jet printing comprising copper salts and a support having coated thereon at least one ink-receiving layer containing binders and at least one nanoporous inorganic oxide, wherein the copper salts are salts of monovalent copper.

2. Recording sheet according to claim 1, wherein the salt of monovalent copper is copper(I)-chloride.

3. Recording sheet according to claim 1, wherein the amount of copper salts is from 10 mg/m$^2$ to 200 mg/m$^2$.

4. Recording sheet according to claim 1, wherein the recording sheet further comprises tautomeric compounds of formulas Ia (diketo form) and Ib (enol form)

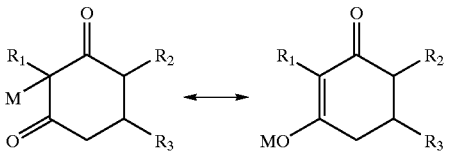

Ia Ib wherein

M represents a hydrogen cation, a metal cation or an ammonium cation optionally substituted by one or more alkyl or substituted alkyl groups each having from 1 to 18 C atoms;

$R_1$ represents hydrogen, alkyl with 1 to 12 C atoms or substituted alkyl with 2 to 6 C atoms, wherein the substituents are selected from the group consisting of CN, COOH, OH and $COOR_4$, where $R_4$ represents alkyl with 1 to 12 C atoms; and $R_2$, $R_3$ independently represent hydrogen, alkyl with 1 to 6 C atoms or substituted alkyl with 2 to 6 C atoms, wherein the substituents are selected from the group consisting of CN, COOH, OH and $COOR_5$, where $R_5$ represents alkyl with 1 to 12 C atoms.

5. Recording sheet according to claim 1, wherein the nanoporous inorganic oxide is colloidal aluminium oxide, colloidal aluminium oxide/hydroxide or positively charged silicium dioxide.

6. Recording sheet according to claim 1, wherein the nanoporous inorganic oxide is colloidal $\gamma$-$Al_2O_3$ or pseudo-boehmite.

7. Recording sheet according to claim 1, wherein the nanoporous inorganic oxide is AlOOH or pseudo-boehmite comprising one or more of the elements of the rare earth metal series of the periodic system of the elements with atomic numbers 57 to 71 in an amount of from 0.4 to 2.5 mole percent relative to $Al_2O_3$.

8. Recording sheet according to claim 1, wherein the binder is selected from the group consisting of gelatin, polyvinyl alcohol and polyvinyl pyrrolidone or mixtures thereof.

9. Recording sheet according to claim 1, wherein the support is selected from coated or uncoated paper, transparent or opaque polyester or fibrous textile materials.

* * * * *

UNITED STATES PATENT AND TRADEMARK OFFICE

CERTIFICATE OF CORRECTION

PATENT NO. : 6,660,347 B2
DATED : December 9, 2003
INVENTOR(S) : Steiger

It is certified that error appears in the above-identified patent and that said Letters Patent is hereby corrected as shown below:

Column 8,
Line 34, delete "4º" and insert -- 40º --.

Column 9,
Lines 33 and 48, delete "4º" and insert -- 40º --.

Signed and Sealed this

Sixth Day of April, 2004

JON W. DUDAS
*Acting Director of the United States Patent and Trademark Office*